US009049774B2

(12) United States Patent
Shu

(10) Patent No.: US 9,049,774 B2
(45) Date of Patent: Jun. 2, 2015

(54) EUVL LIGHT SOURCE SYSTEM AND METHOD

(71) Applicant: Semiconductor Manufacturing International (Shanghai) Corporation, Shanghai (CN)

(72) Inventor: Emily Yixie Shu, Shanghai (CN)

(73) Assignee: SEMICONDUCTOR MANUFACTURING INTERNATIONAL (SHANGHAI) CORPORATION, Shanghai (CN)

( * ) Notice: Subject to any disclaimer, the term of this patent is extended or adjusted under 35 U.S.C. 154(b) by 0 days.

(21) Appl. No.: 14/333,268

(22) Filed: Jul. 16, 2014

(65) Prior Publication Data

US 2015/0034845 A1 Feb. 5, 2015

(30) Foreign Application Priority Data

Jul. 24, 2013 (CN) ..... 2013 1 0315299

(51) Int. Cl.
*H05G 2/00* (2006.01)

(52) U.S. Cl.
CPC ..... *H05G 2/008* (2013.01)

(58) Field of Classification Search
CPC ..... H05G 2/008; H05G 2/005; H05G 2/006; H05G 2/003
USPC ..... 250/493.1, 504 R; 378/119, 134
See application file for complete search history.

(56) References Cited

U.S. PATENT DOCUMENTS 8,237,132 B2 * 8/2012 Peng et al. ..... 250/492.1
2014/0078480 A1 * 3/2014 Park et al. ..... 355/67

* cited by examiner

*Primary Examiner* — Michael Maskell
(74) *Attorney, Agent, or Firm* — Anova Law Group, PLLC

(57) ABSTRACT

EUVL light source systems and methods are provided. A laser or a high-voltage-discharge device is used to excite EUV light source material to generate EUV light along with droplets flying out of the EUV light source material. A collector is positioned to guide the EUV light into a desired direction. A cooling assembly is configured to wrap around the collector along the EUV light in the desired direction. At least a first portion of the plurality of molten droplets reaches and condenses on a surface of the cooling assembly.

17 Claims, 10 Drawing Sheets

EUVL LIGHT SOURCE SYSTEM AND METHOD

CROSS-REFERENCES TO RELATED APPLICATIONS

This application claims priority to Chinese Patent Application No. 201310315299.5, filed on Jul. 24, 2013, the entire content of which is incorporated herein by reference.

FIELD OF THE DISCLOSURE

The present disclosure generally relates to the field of semiconductor technology and, more particularly, relates to extreme ultraviolet lithography (EUVL) light source systems and methods for configuring and using the EUVL light source systems.

BACKGROUND

Lithography is a process of transferring desired patterns onto a substrate (typically a target area of the substrate) such that patterns are created in different device regions or current regions. Specifically, using exposure in a lithography process, a pattern can be created onto a photoresist layer (made of a photo-sensitive polymer material) disposed on surface of the substrate to achieve pattern transfer.

With rapid development of semiconductor manufacturing technologies, critical dimensions (CDs) of patterns exposed by the lithography process have been reduced, which requires high resolution of lithography. The lithography resolution, or the minimum critical dimension of lithography, is given based on the Rayleigh's criterion, as shown in equation (1):

$$CD=\kappa 1\times\lambda/NA \quad (1)$$

where $\lambda$ is exposure wavelength of the lithography process; NA is numerical aperture of the projection system of lithographic equipment; $\kappa 1$ is a lithography process-related factor; and CD is the critical dimension of the printed pattern. According to the above equation (1), CDs can be reduced by three methods, i.e., reducing the exposure wavelength, increasing the numerical aperture, or decreasing the $\kappa 1$ factor.

EUVL has been considered the most promising lithographic technology. EUVL radiation is an electromagnetic radiation having a wavelength ranging from 5 nm to 20 nm and is currently generated by either laser-produced plasma (LPP) or discharge-produced plasma (DPP).

EUVL light source system for generating EUV light usually includes a source-excitation module for generating EUV-light-producing plasma from a vaporized source material, and a collector module for collecting and collimating the appropriate EUV light generated from the EUV light source-excitation module into an optical non-tele-centric system. In a laser-produced plasma system, the source-excitation module usually applies high-energy laser beams to the source material which then produces plasma in the excitation source. In a discharge produced plasma system, high voltage produces plasma which generates EUV light from the excitation source. The collector module has a number of optical elements used to direct, select and collimate the EUV light at a desired wavelength into an output EUV beam.

However, when a conventional EUV light source system excites the solid source material into vapor which then forms EUV-producing plasma, the source material vapor droplets may condense on the EUV light-collecting optical elements. As a result, these condensed droplets can contaminate EUV light reflecting optics in the light source system. In addition, the downstream EUV-collecting optics can be contaminated by the flying-over droplets. Once contaminated, light-collecting efficiency goes down quickly. The disclosed methods and systems are directed to solve one or more problems set forth above and other problems.

BRIEF SUMMARY OF THE DISCLOSURE

One aspect or embodiment of the present disclosure includes EUVL light source system. The EUVL light source system includes a laser, a collector, and a cooling assembly. The laser is configured to excite EUV light source material to emit EUV light. A plurality of molten droplets is generated to fly out of the EUV light source material. The collector is positioned to guide the EUV light into a desired direction. The cooling assembly is configured to wrap around the collector along the EUV light in the desired direction. At least a first portion of the plurality of molten droplets reaches and condenses on a surface of the cooling assembly.

Another aspect or embodiment of the present disclosure includes EUVL light source system. The EUVL light source system includes a high-voltage-discharge device, a collector, and a cooling assembly. The high-voltage-discharge device is configured to provide a high-voltage discharge pulse to excite EUV light source material to emit EUV light. A plurality of molten droplets is generated to fly out of the EUV light source material. The collector is positioned to guide the EUV light into a desired direction. The cooling assembly is configured to wrap around the collector along the EUV light in the desired direction. At least a first portion of the plurality of molten droplets reaches and condenses on a surface of the cooling assembly.

Another aspect or embodiment of the present disclosure includes a method for configuring EUVL light source system by providing a laser or a high-voltage-discharge device to excite EUV light source material to emit EUV light. A plurality of molten droplets is also generated to fly out of the EUV light source material. A collector is positioned to guide the EUV light into a desired direction. A cooling assembly is configured to wrap around the collector along the EUV light in the desired direction. At least a first portion of the plurality of molten droplets reaches and condenses on a surface of the cooling assembly.

Other aspects or embodiments of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Figure 1:
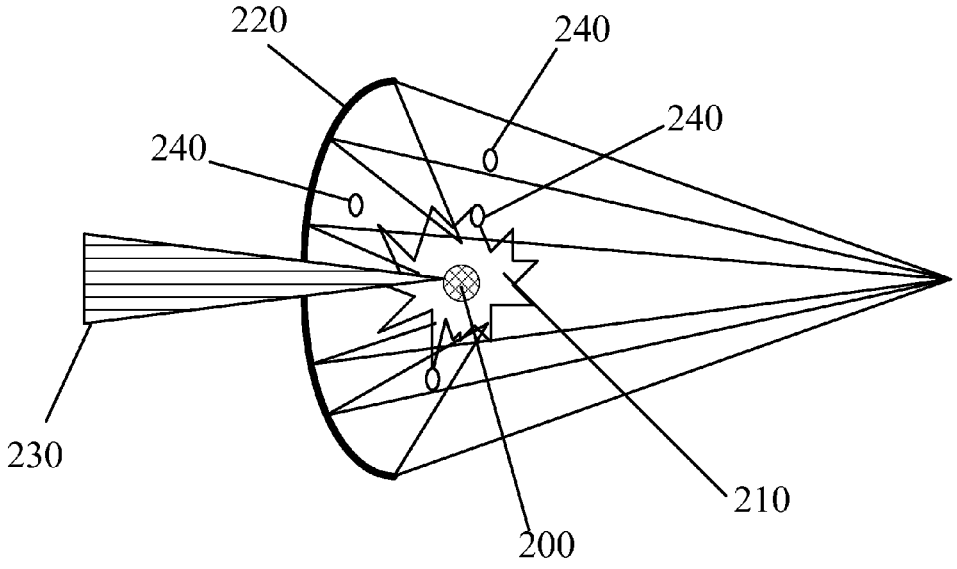
FIG. 1 depicts a system for EUVL light source that applies a high-energy laser beam to an EUV light source material to generate EUV light.

Reference will now be made in detail to exemplary embodiments of the disclosure, which are illustrated in the accompanying drawings. Wherever possible, the same reference numbers will be used throughout the drawings to refer to the same or like parts.

EUV light can be generated by plasma from a number of source materials. A light source system for generating EUV light can usually include a source-excitation module for exciting a source material to provide EUV-light-producing plasma, and a collector for collecting EUV light at a desired wavelength. The source-excitation module can apply a high-energy laser beam to the EUV light source material, or apply a high-voltage discharge to the EUV light source material (i.e., charge the EUV light source material at high voltages), such that plasma can be generated. The plasma can emit the EUV light. The collector can include a reflective-mirror-type normal incidence radiation collector, or a collector used for receiving the EUV light and collimating the EUV light into a beam.

The EUV light source material can include metal (e.g. tin and lithium) particle(s), a gas (e.g., xenon), and/or a vapor stream (e.g., lithium vapor). When the EUV light source material is excited, the excitation of the EUV light source material usually is incomplete. After a vaporization phase, source material vapor droplets (or droplets) may condense from the incomplete excitation of the EUV light source material.

Droplets may fly or otherwise spread irregularly at various speeds and at various directions. In one example, some droplets may fly toward the collector and be incident on a reflecting surface of the collector within EUV exposure device, and thus can reduce reflectivity of the collector surface, or adhere to the collector surface to cause contamination. In another example, some droplets may fly (or spread) along a direction of the collimated EUV light towards other components (e.g., a collimator) of the EUV exposure device to contaminate. Costs for cleaning can also be increased.

Additionally, such droplets, however, are molten droplets. The molten droplets may fly (or spread) in any possible directions to contaminate components in the EUV exposure device. Further, the molten droplets that fall on component surfaces may drip down onto other component surfaces to cause secondary contaminations.

Various embodiments provide an exemplary EUVL light source system including a cooling assembly, a collector (or a light collector assembly), EUV light generating device (including, e.g., a laser and EUV light source material), etc.

The EUV light generating device can be configured to generate EUV light. Droplets formed during the EUV light generation can fly out of the EUV light source material.

The collector can be configured to guide the EUV light. In various embodiments, the guiding of the EUV light can refer to any appropriate functions including collecting, directing, converging, and/or collimating the EUV light into a beam or into a focus point, without limitations.

The cooling assembly can be configured to receive and condense the droplets flying toward the cooling assembly at different speeds and different directions. The cooling assembly can form an exterior wall to wrap around a predetermined space, within which the EUV light can be guided. The cooling assembly can cool the droplets and condense the droplets on surface of the cooling assembly to avoid contamination of the droplets onto surrounding components (e.g., a possible collimator) of the system. In addition, the droplets can be condensed on the surface of the cooling assembly to avoid secondary contaminations. In one embodiment, the cooling assembly can include a cooling material including, e.g., a water coolant, liquid nitrogen, and/or liquid helium. In another embodiment, the cooling assembly can include an electro-thermal cooling condenser.

In various embodiments, the exemplary EUVL light source system having the cooling assembly can include a collector formed by a number of movable reflective mirrors. The movable reflective mirrors can effectively reflect EUV light and can reduce risk of contaminations from droplets. For example, a reflective mirror can be configured to change between a reflective state and a non-reflective state. When the EUV light source material is excited, the reflective mirror can be configured in the reflective state for reflecting EUV light. After the EUV light source material is excited, the reflective mirror can be configured in the non-reflective state for avoiding the droplet contamination. Contamination of the collector can be further prevented.

Specifically, when the reflective mirrors are configured in the reflective state, the reflective mirrors can be configured to direct the EUV light. When the reflective mirrors are configured in the non-reflective state, a reflective surface of each reflective mirror can be rotated substantially parallel to a flying direction of the droplets. For example, a reflective mirror (or the reflective surface of a reflective mirror) can be rotated to be substantially parallel to flying direction of corresponding droplets flying toward this reflective mirror. Thus, probability of the droplets to fall onto the reflective surface of each reflective mirror can be reduced, and risk of contamination of the reflective mirrors can also be reduced. In various embodiments, a reflective mirror configured parallel to the flying direction of droplets can refer to a reflective mirror configured parallel to the flying direction of the droplets that are near or close or adjacent to the reflective mirror.

The reflective mirror can be made of a material including molybdenum, molybdenum alloy, silicon, ruthenium, and/or ruthenium alloy. Alternatively, the reflective mirror can have a silicon substrate and the silicon substrate can have a surface coated (e.g., plated) with a multi-layer structure including, e.g., silicon molybdenum film(s), molybdenum alloy, ruthenium and/or ruthenium alloy film(s).

The reflective mirror can be movable and can be rotated along a predetermined axis. The predetermined axis can be a central axis of the reflective mirror, a center line of the EUV light source material, or any straight line located in the EUVL light source system. The predetermined axis can be selected based on the consideration that the reflective mirror can be contaminated less by the droplets when rotating along the predetermined axis compared with other possible axes. Of course, the predetermined axis can be selected as desired according to the actual EUVL light source system, and is not limited in any manner in the present disclosure.

The reflective mirror can be movable by providing a mirror control system including, e.g., using electric control, magnetic control, and/or mechanical control, to control movement of the movable reflective mirrors.

When cooling (e.g., including further condensing) the droplets by the cooling assembly, the movable reflective mirror can be controllably moved to avoid contamination from droplets, which in turn cleans the interior of the EUV exposure device. Lifetime or life cycle of the EUV exposure device can be increased, and maintenance costs can be reduced.

FIG. 1 depicts EUVL light source system. A high-energy laser beam can be applied to EUV light source material to generate EUV light. For example, a process of applying the high-energy laser beam to the EUV light source material to generate the EUV light can include exposing the EUV light source material with a laser beam (or a laser pulse) to generate plasma. The plasma can thus radiate to emit EUV light.

Referring to FIG. 1, in one embodiment, the EUVL light source system can include EUV light source material 200. The EUV light source material can include, for example, Xe, Sn, and/or Li. The EUVL light source system can further include laser 230. Laser 230 can be configured to provide laser beam. The laser beam can be used for heating EUV light source material 200 to generate plasma 210. Laser 230 can include a $CO_2$ laser to excite or activate a laser having a wavelength of about 10.6 microns. Plasma 210 can radiate to output EUV light.

The EUVL light source system can further include collector 220 provided at a periphery of EUV light source material 200 to at least partially surround EUV light source material 200. Collector 220 can be configured to guide the EUV light.

As discussed above, the excitation of the EUV light source material is usually incomplete and droplets 240 are generated after EUV light source material 200 has been excited. Some droplets 240 may fly onto surface of collector 220 of EUV exposure device (and/or other optic components) to reduce surface reflectivity of collector 220, or to adhere on surface of collector 220.

Figure 2:
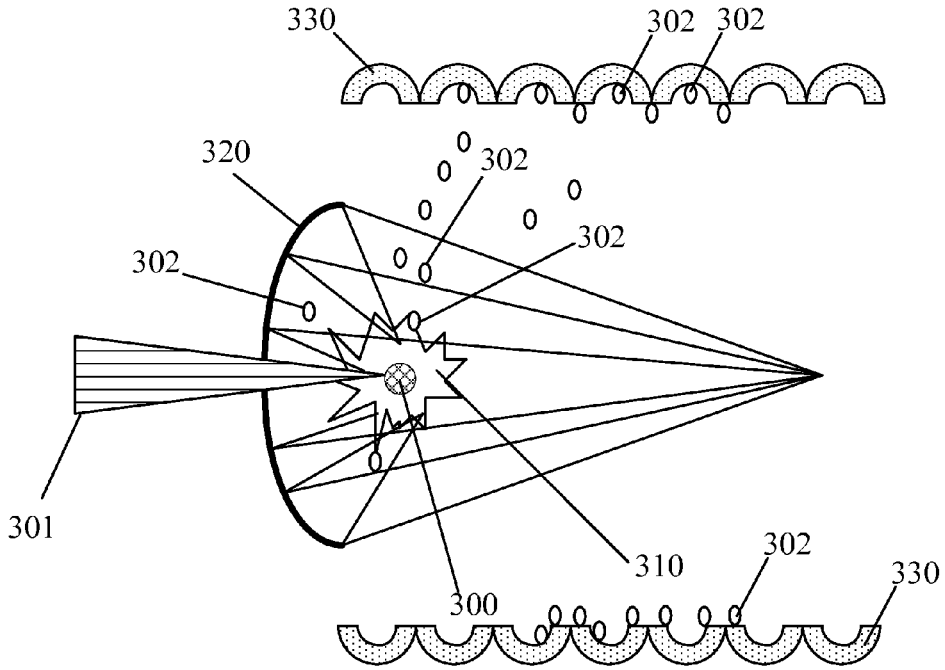
FIG. 2 depicts an exemplary EUVL light source system in accordance with various disclosed embodiments.

FIG. 2 depicts an exemplary EUVL light source system having a cooling assembly. The system of FIG. 2 can include: EUV light source material 300, laser 301, collector 320, and/or cooling assembly 330.

EUV light source material 300 can include, e.g., Xe, Sn, or Li. Laser 301 can provide laser beam to heat the EUV light source material to generate plasma 310. Laser 301 can be a $CO_2$ laser device and can have a laser with an excitation wavelength of about 10.6 μm. Plasma 310 can emit EUV light. Collector 320 can guide EUV light emitted from plasma 310. Within a predetermined space, the EUV light can be collected and guided by collector 320 and/or cooling assembly 330.

Cooling assembly 330 can wrap around to form an exterior wall to cover the predetermined space for guiding the EUV light. Cooling assembly 330 can receive and condense droplets 302. Cooling assembly 330 can be configured to condense the droplets onto surface of the cooling assembly to avoid contaminations from the droplets to other components. In addition, the droplets condensed on surface of the cooling assembly without dripping off can avoid secondary contaminations. Cooling assembly 330 can use a cooling material disposed therein. The cooling material can include, e.g., a water coolant, liquid nitrogen, and/or liquid helium. In one embodiment, the cooling assembly can include an electro-thermal cooling condenser.

In one embodiment, cooling assembly 330 can be disposed around a guided direction of the EUV light to form a predetermined space such as a cavity (e.g., centered by the guided EUV light), and cooling assembly 330 can wrap around the cavity to form an exterior wall as shown in FIG. 2. The EUV light can be guided in the cavity by the collector and the cooling assembly 330. Droplets flying toward cooling assembly 330 can be condensed on inner surface of cooling assembly 330.

Optionally, cooling assembly 330 can be configured as a tube containing a cooling material. The tube can wrap around a predetermined space including, e.g., a chamber of the EUV exposure device where the EUV light can be guided in a desired direction. The tube can have a cooling material including, e.g., a water coolant, liquid nitrogen, and/or liquid helium, so that the droplets can be condensed on the inner surface of the tube.

When laser beam excites EUV light source material 300 to generate EUV light, droplets 302 are also generated to fly out of EUV light source material 300 (e.g., having an excitation center) in excitation chamber. A preset (or fixed) distance can be set between EUV light source material 300 and collector (or collector mirror) 320 in the excitation chamber. Often the collector can have a cavity radius as shown in FIGS. 1-2.

Droplets flying out of EUV light source material 300 by a same laser pulse may travel in the excitation chamber at different speeds, for example, ranging from about 1 m/sec to about 100 m/sec, and toward different directions. One or more fastest droplet(s) can reach the collector mirror surface after a fastest flying time of these fastest droplet(s). As known, speed of light is much greater than speed of droplets. EUV light can therefore reach collector mirror surface earlier than any droplets (fast or slow). The fastest flying time of fastest droplet(s) can be calculated from a time for starting the laser pulse to generate fastest droplet(s) to a time for the fastest droplet(s) to arrive on the collector mirror surface.

Droplets that travel at different speeds can arrive on the collector mirror surface at different times. For collector 320 having cavity radius ranging from about 10 cm to about 30 cm, the fastest droplet(s) can take about 1 millisecond for the 10 cm-radius to about 3 milliseconds for the 30 cm-radius to arrive at collector mirror surface.

A time length T sandwiched between two consecutive laser pulses (or two consecutive laser irradiations) can correspond to the arrival time for droplets at all speeds at the collector mirror surface. The flying speed of a droplet can be decided by, e.g., laser energy, source material, droplet size/mass, distance from source to the collector, and/or geometry of the excitation chamber.

Figure 3A:
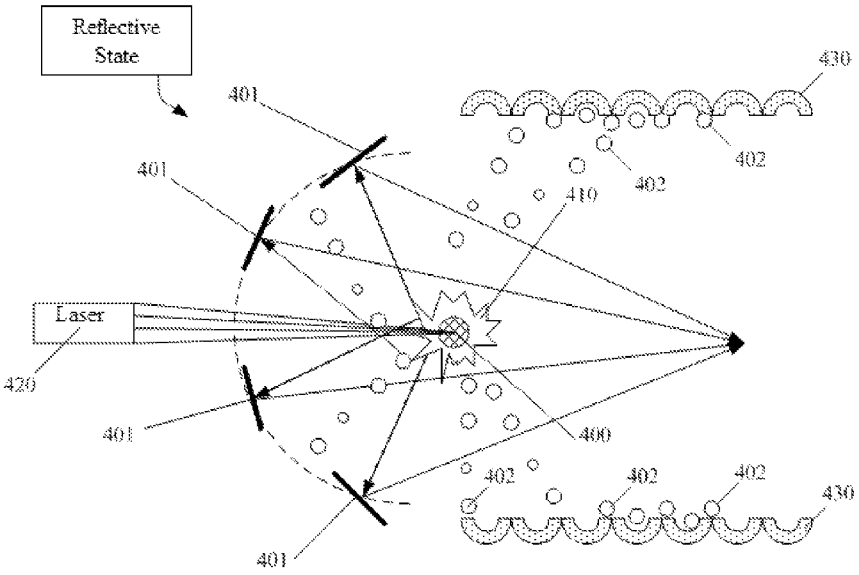
FIG. 3A depicts an exemplary EUVL light source system set in a reflective state in accordance with various disclosed embodiments.
Figure 3B:
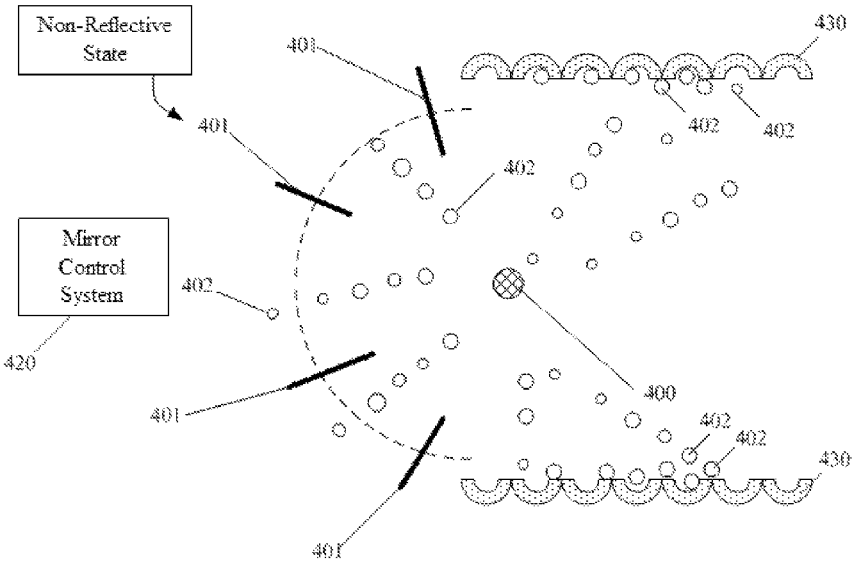
FIG. 3B depicts an exemplary EUVL light source system set in a non-reflective state in accordance with various disclosed embodiments.

FIGS. 3A-3B depict another exemplary EUVL light source system having a cooling assembly in accordance with various embodiments in the present disclosure. The exemplary EUVL light source system includes: EUV light source material 400, laser 420, collector formed by multiple reflective mirrors 401, and/or cooling assembly 430.

EUV light source material 400 can be, e.g., Xe, Sn, and/or Li. Laser 420 can provide laser beam to heat EUV light source material 400 to generate plasma 410. The laser can be, e.g., a $CO_2$ laser device, to produce a laser beam and/or laser pulse with an excitation wavelength of about 10.6 μm. Plasma 410 generated by the laser can emit EUV light.

The collector is formed by multiple reflective mirrors 401 for collecting EUV light. Reflective mirrors 401 are controlled to have reflective state and non-reflective state during EUV light collection. In reflective state, reflective mirrors are set to reflect and guide EUV light into a predetermined or any desired direction and further guided by cooling assembly 430. In non-reflective state, reflective mirrors are set to avoid contamination by arrived droplets 402 following the laser beam/pulse. The fastest droplet(s) 402 can reach the collector after a fastest flying time from when laser pulse starts. That is, after starting of a laser pulse and before fastest droplet(s) 402 reaches the collector, reflective mirrors can be set non-reflective to avoid contamination by fastest droplet(s) 402 and following droplets.

Cooling assembly 430 condenses the droplets 402. Cooling assembly 430 can wrap around to form an exterior wall to cover a predetermined space, in which the EUV light can be guided. Cooling assembly 430 can be the same or different from cooling assembly 330 depicted in FIG. 2.

Reflective mirrors 401 can be arranged along (e.g., surrounding) EUV light source material 400. In one embodiment, the collector formed by reflective mirrors 401 can guide the EUV light after reflected in the predetermined direction, e.g., to be parallel or to focus on a middle focal point (or a virtual source point).

Any desired number of reflective mirrors 401 can be included. The more reflective mirrors can be better in mitigating contamination of the droplets 402. However, more reflective mirrors 401 can lead to, e.g., increased complexity for controlling reflection, and increased cost. The number of reflective mirrors 401 can be selected based on reflective surface and mirror size according to specific needs of EUV exposure.

Reflective mirrors 401 can be made of a thermally stable substrate coated with high EUV reflective material including, e.g., molybdenum, molybdenum alloy, silicon, ruthenium and/or ruthenium alloys. Alternatively, reflective mirrors 401 can have a silicon substrate, and a surface of the silicon substrate can be coated or plated with multiple layers selected from, e.g., silicon, molybdenum, molybdenum alloy, ruthenium, and/or ruthenium alloy film.

The EUVL light source system can thus include EUV light generator including laser 420 and EUV light source material 400 to generate EUV light. Laser 420 can be a pulsed laser which creates EUV emitting plasma 410. It should be noted that the EUV light generator can be configured independently from the EUVL light source system or be configured within the disclosed EUVL light source system.

Referring to FIG. 3A, reflective mirrors 401 are configured in reflective state. For example, laser 420 of the EUV light generator can output laser beam to excite EUV light source material 400 to create plasma 410. The laser beam can be in a pulse mode. When the laser pulse is switched on, laser beam can be incident on the EUV light source material 400 for a time length (e.g., referred to as "incidence time") to create plasma 410 which then emits EUV light. At the same time, multiple reflective mirrors 401 can have their reflective surface(s) facing at the EUV light. In such reflective state, the assembly of reflective mirrors can form an enclosing reflective surface to guide the EUV light onto a desired or predetermined direction.

When laser beam excites EUV light source material 400 to generate EUV light, droplets 402 are also generated to fly out of the EUV light source material 400 in excitation chamber. A preset (or fixed) distance can be set between the EUV light source material 400 and corresponding reflective mirror 401. Often a reflective mirror 401 can have a cavity radius as shown in FIGS. 3A-3B.

Droplets flying out of the EUV light source material 400 by same laser beams or laser pulse may travel in the excitation chamber at different speeds, for example, ranging from about 1 m/sec to about 100 m/sec. One or more fastest droplet(s) can reach a corresponding reflective mirror 401 after a fastest flying time of these fastest droplet(s). As known, speed of light is much greater than speed of the droplets. EUV light can reach the same reflective mirror earlier than any droplets (fast or slow). The fastest flying time of fastest droplet(s) can be calculated from a time for starting the laser pulse to generate fastest droplet(s) to a time for fastest droplet(s) to arrive on the corresponding reflective mirror 401.

Droplets that travel at different speeds can arrive on a corresponding reflective mirror 401 at different times. In one example, for 100 Hz laser excitation frequency and 10 cm size excitation chamber, the droplets (or debris droplets) can arrive on the corresponding reflective mirror 401 at a time after the laser pulse by about 1 millisecond to 100 milliseconds. When multiple reflective mirrors 401 are configured to have a collector cavity radius (e.g., from about 10 cm to about 30 cm), the fastest droplet(s) can take about 1 milliseconds for 10 cm radius to about 3 milliseconds for radius 30 cm to arrive at corresponding reflective mirrors 401.

Referring to FIG. 3B, reflective mirrors 401 are configured in non-reflective state. When the incidence time (or a time length after the incidence of laser beam on EUV light source material 400) stops, reflective mirrors 401 can be configured non-reflective. In one embodiment, reflective mirrors 401 can have their reflective surfaces configured in parallel with flying directions of droplets 402 to allow these droplets 402 to pass through adjacent reflective mirrors (e.g., when configured non-reflective).

A time length T sandwiched between two consecutive laser pulses can correspond to the arrival time at a same reflective mirror by droplets at all speeds. Flying speed of a droplet can be decided by, e.g., laser energy, source material, droplet size/mass, distance from source to the collector, and/or geometry of the excitation chamber. For example, before the next laser pulse triggers the reflective mirrors to rotate back to reflective mode droplets, substantially all droplets (or in some cases about 80% or greater of all droplets flying toward the collector) can arrive on location of corresponding reflective mirror to pass through corresponding adjacent reflective mirrors configured non-reflective.

Therefore, to better avoid the contamination by droplets 402, reflective mirrors 401 can be controlled either reflective or non-reflective corresponding to the pulse mode of the incident laser beam. For example, reflective mirrors 401 can flip to non-reflective state in order to avoid facing at the flying direction(s) to receive droplets 402 at a time after starting of incident laser pulse but before the fastest droplet(s) arrive at a mirror surface from the excitation center, while EUV light can arrive at and be guided by the same mirror surface at an earlier time. As discussed above, the time length from starting incident laser pulse to the fastest droplet(s) arriving at mirror surface can be referred to as fastest flying time.

Laser 420 can be pulsed laser or pulsed laser clusters. Laser 420 can also be a continuous-firing laser and/or laser clusters that are time-modulated into pulsed strings. The time for configuring reflective mirrors 401 non-reflective can lag behind pulse duration time of incident laser beam by a delay time T1. That is, a starting time of reflective mirrors 401 being in the non-reflective state can lag behind a starting time of pulse duration time of incident laser beam for each laser pulse cycle by the delay time T1, e.g., ranging from about 1 millisecond to about 100 milliseconds (e.g., about 1 millisecond as shown by waveform D in FIG. 4). Such lag-behind delay time T1 for configuring non-reflective can be shorter than or substantially equal to the fastest flying time of the fastest droplets to reach locations of corresponding reflective mirrors. The delay time T1 is configured to open the reflective mirrors to pass the fastest among the second portion molten droplets.

Figure 4:
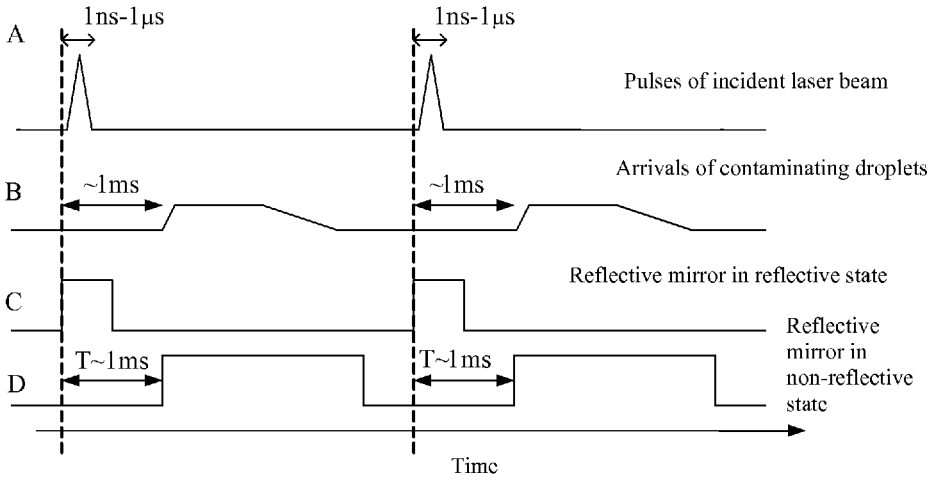
FIG. 4 depicts time sequences of pulses of an incident laser beam, arrivals of droplets, a reflective mirror being in a reflective state, and a reflective mirror being in a non-reflective state, as a function of time in accordance with various disclosed embodiments.

FIG. 4 depicts exemplary time sequences of A) pulses of an incident laser beam, B) arrivals of droplets, C) reflective mirror being reflective, and D) reflective mirror being non-reflective, as a function of time in accordance with various disclosed embodiments.

As shown, waveform A corresponds to pulses of an incident laser beam, waveform B corresponds to arrivals of droplets, waveform C corresponds to a reflective state of a reflective mirror, and waveform D corresponds to a non-reflective state of a reflective mirror.

For illustrative purposes, in this example, the incident laser beam can have a pulse duration time ranging from about 1 nanosecond to about 1 microsecond, as shown by waveform A in FIG. 4. And it can take about 1 millisecond for the fastest droplet(s) 402 to arrive at the reflective mirrors 401.

Waveform A shown in FIG. 4 depicts a pulse frequency of an incident laser beam. The incident laser beam can have a pulse duration time ranging from about 1 nanosecond to about 1 microsecond. Correspondingly, waveform B as shown in FIG. 4 depicts a time length when droplets 402 at various speeds arrive at the collector (or mirror locations) of corresponding reflective mirrors 401. For example, starting at about 1 millisecond after a starting time of the laser beam, the fastest droplet(s) can arrive at a mirror location of corresponding reflective mirror(s) 401. Following the fastest droplet(s), slow droplets 402 can then arrive. In certain embodiments, the slowest droplets are allowed to all pass through the mirror locations where the reflective mirrors are configured non-reflective, before the next laser pulse is applied to trigger the reflective mirror(s) to switch to the reflective state.

Correspondingly, waveform C shown in FIG. 4 depicts a reflective mirror 401 to be in the reflective state as a function of time. Because reflective mirrors 401 are controlled to accommodate to the EUV light, the time length of reflective mirrors 401 being in the reflective state can be longer than the pulse duration time of the incident laser beam. However, reflective mirrors 401 must be switched off from the reflective state before the fastest droplets arrive at the locations of reflective mirrors 401.

The non-reflective state of the reflective mirrors may start no later than the arrival time of the fastest droplet(s) at a location of a corresponding reflective mirror. The non-reflective state of the reflective mirrors may end before the next laser pulse starts to switch the reflective mirror to be reflective. For example, the slowest droplets are allowed to pass through such location by adjusting a laser frequency and by adjusting cavity design formed including multiple reflective mirrors.

Correspondingly, waveform D shown in FIG. 4 depicts the reflective mirrors 401 being in the non-reflective state as a function of time. The reflective mirrors 401 have to be in the non-reflective state before the fastest droplet(s) 402 arrive at the location corresponding to the reflective mirrors 401. Therefore, the reflective mirrors 401 being in the non-reflective state should be configured to have a sufficiently long time to allow droplets 402 at all speeds to pass through the mirror locations to avoid contamination. Then, the reflective mirrors 401 can be switched to the reflective state following the next pulse of the laser beam to guide EUV light generated from the laser beam.

In various embodiments, the time sequence of the reflective mirrors 401 being in the reflective state or the non-reflective state can be set based on parameters including a pulse duration time of the incident laser beam, an incidence time of the incident laser beam, a speed of the incident laser beam, a speed of the EUV light, designed size of components of the EUVL light source system, type of the EUV light source material, and/or size/mass of the droplets.

In various embodiments, a mirror control system can be provided to control the switching of the reflective mirrors 401 between the reflective state and the non-reflective state. The mirror control system can include, e.g., electric control, magnetic control, and/or mechanical control.

In this manner, the time length of the reflective mirrors 401 being in the reflective state can be greater than the pulse duration time of the incident laser beam and less than fastest flying time of the fastest droplet(s) 402 to arrive at location of the reflective mirrors 401. The time length for a droplet 402 to arrive at location of the reflective mirrors 401 can refer to a time length between a starting time of the pulse duration time of the incident laser beam and a time when the droplet 402 arrives at the reflective mirrors 401. The time length of the reflective mirrors 401 being in the non-reflective state can be greater than the time length for droplets 402 at all speeds to pass through locations of the reflective mirrors 401. Then, the reflective mirrors 401 can be switched to be reflective during the next pulse of the incident laser beam.

Figure 5:
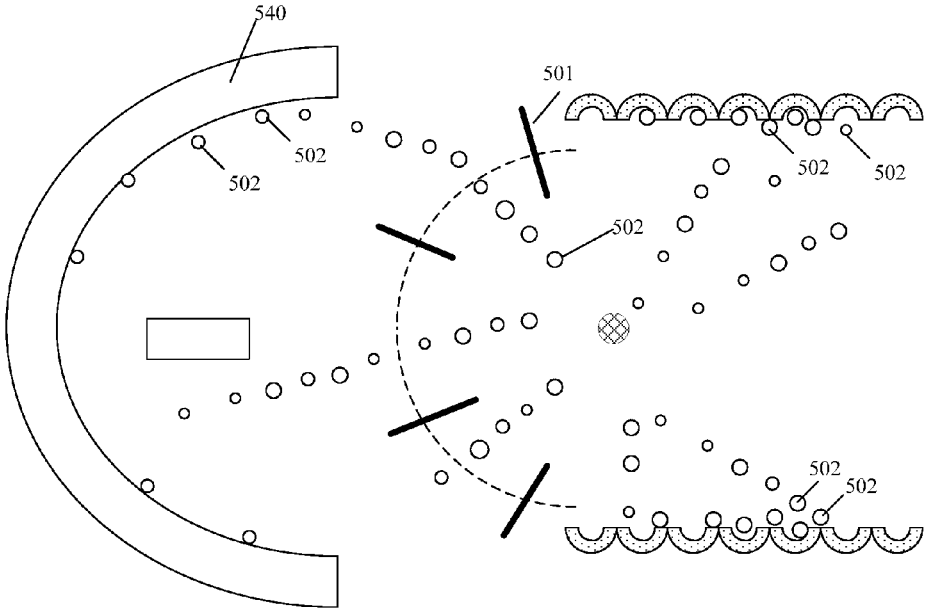
FIG. 5 depicts another exemplary EUVL light source system including an outer droplet stopper in accordance with various disclosed embodiments.

FIG. 5 depicts another exemplary EUVL light source system including an outer droplet stopper in accordance with various disclosed embodiments. As shown, an outer droplet stopper 540 can be provided at an outer periphery of a collector. The outer droplet stopper 540 can be configured to capture droplets 502 that fly out of the EUV light source material 500 at all speeds to prevent droplets 502 from contaminating other possible components of the EUV exposure device.

The outer droplet stopper 540 can include a bowl-like structure or a frame-like structure provided outside the collector (e.g., including multiple reflective mirrors 501) and regions surrounding the collector. When the droplet(s) 502 fly out through a gap between adjacent reflective mirrors 501, the outer droplet stopper 540 can capture droplet(s) 502 to prevent droplets 502 from contaminating components of the EUV exposure device.

As such, the disclosed embodiments include a cooling assembly to condense droplets on surface of the cooling assembly to avoid contamination of the droplets. In addition, the droplets can be condensed on the surface of the cooling assembly without dripping off to avoid secondary contaminations.

In one embodiment, the laser beam can be in a continuous mode. When the laser beam is a continuous mode, the collector can be either movable or immovable. Optionally, the collector can collect the EUV light in a stationary mode, e.g., the mirrors of the collector can be stationary. In another embodiment, the laser beam is in a pulse mode. The disclosed embodiments can have movable reflective mirrors that can be rotated along a predetermined axis while accommodating the EUV light, so that the reflecting surfaces of the reflective mirrors can avoid droplet contamination to reduce maintenance costs of the EUV exposure device.

Further, when the laser beam is in the pulse mode, the reflective mirrors can be movable around a predetermined axis and configured to be in a reflective or non-reflective state. When the reflective mirrors are set to be in the reflective state, the reflective mirrors can be configured to guide the EUV light. When the reflective mirrors are set to be in the non-reflective state, the reflective surfaces of the reflective mirrors can be rotated following (e.g., parallel to) the flying directions of the droplets, such that contamination of the reflective surface(s) of the reflective mirrors by the droplets can be reduced to a minimum.

The reflective mirrors can be in the reflective state or the non-reflective state corresponding to the pulse mode of the incident laser beam. The time or the time length of the reflective mirrors being in the reflective state or the non-reflective state can be set based on parameters including a pulse duration time of the incident laser beam, an incident time of the incident laser beam, a speed of the incident laser beam, a speed of the EUV light, designed size of components of the EUVL light source system, type of the EUV light source material, and/or size/mass of the droplets.

The time length of the reflective mirrors being in the reflective state can be greater than the pulse duration time of the incident laser beam and less than the time length for the droplets to start arriving at the reflective mirrors. The time length for the droplets to start arriving at the reflective mirrors can refer to a time length between a starting time of the pulse duration time of the incident laser beam and a time when the droplets start to arrive at the reflective mirrors or at locations of corresponding reflective mirrors. The time length of the reflective mirrors being in the non-reflective state can be greater than the time length when the droplets can contaminate the reflective mirrors. Thus, the contamination by the droplets can be further reduced.

Figure 6:
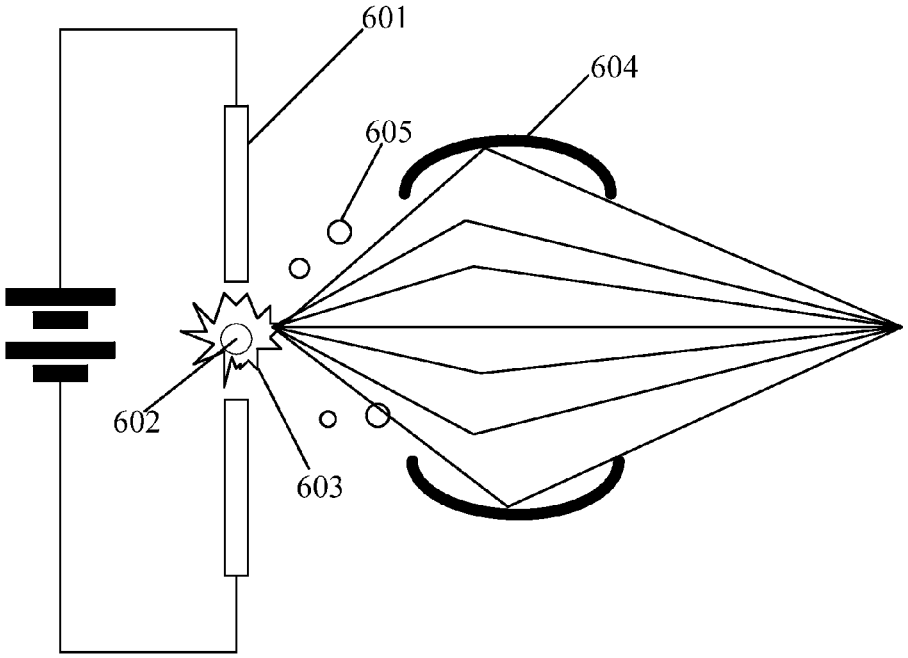
FIG. 6 depicts another exemplary EUVL light source system by applying high-voltage charge pulses to an EUV light source material to generate an EUV light.

FIG. 6 depicts an exemplary EUVL light source system that applies pulsed high-voltage charge to EUV light source material to generate EUV light. For example, a process of applying a high voltage to EUV light source material to generate EUV light can include high-voltage charging the EUV light source material to generate plasma. The plasma can thus emit EUV light.

In various embodiments, when a high voltage is applied to EUV light source material, the EUV light source material can be charged, plasma can be generated by a discharge process triggered by the charging. The charging and discharging process can be substantially simultaneous. Thus, as used herein, a mechanism of exciting EUV light source material to generate plasma using a high-voltage charge can be interchangeably referred to as high-voltage charge or high-voltage discharge.

Referring to FIG. 6, in one embodiment, the EUVL light source system can include EUV light source material 602. The EUV light source material can include, e.g., Xe, Sn, and/or Li. The system can further include high-voltage-discharge device 601. High-voltage-discharge device 601 can be configured to apply a pulsed high voltage to charge EUV light source material 602, and to generate plasma 603. Plasma 603 can output EUV light. The system can further include collector 604 provided at a periphery of EUV light source material 602. Collector 604 can be configured to guide the EUV light.

As previously described, the excitation of the EUV light source material can usually be incomplete. After the EUV light source material is excited, (molten) droplets 605 can be produced. Droplets 605 can be incident on a surface of collector 604 or surface of other optical devices in the EUV exposure device, and thus can reduce reflectivity of the surface of collector 604 or adhere to the surface of collector 604 to cause contamination. Droplets can fly in all possible directions at different speeds, which contaminate the interior components of the EUV exposure device. In addition, the droplets that fall onto the device surface may drip down to cause secondary contaminations.

Figure 7:
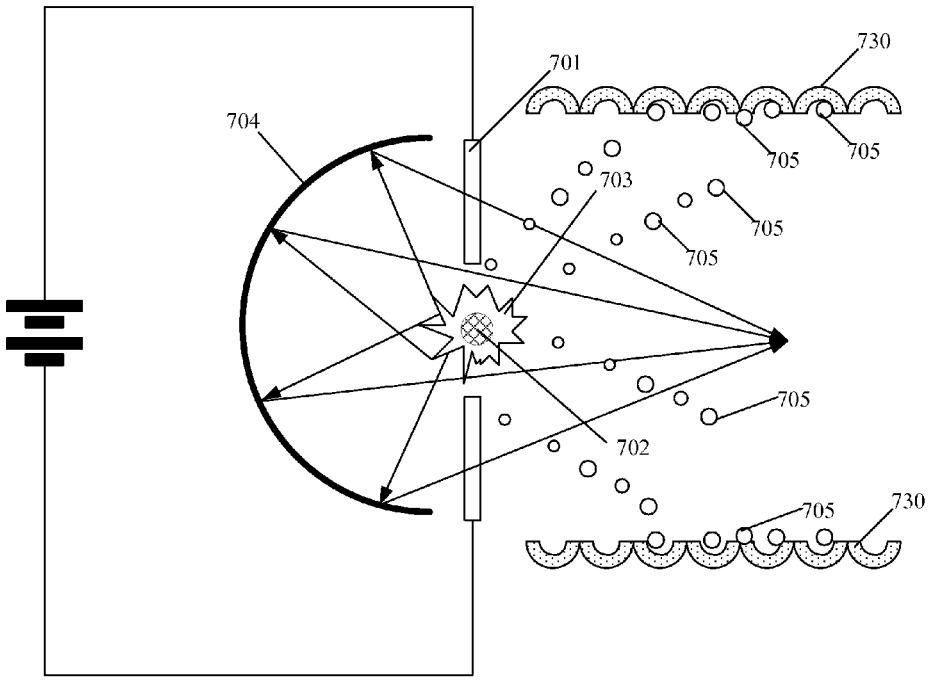
FIG. 7 depicts another exemplary EUVL light source system by applying high-voltage charge pulses to an EUV light source material to generate an EUV light in accordance with various disclosed embodiments.

FIG. 7 depicts an exemplary EUVL light source system in accordance with various embodiments. The exemplary system in FIG. 7 can include EUV light source material 702, high-voltage-discharge plasma unit 701, collector 704, and cooling assembly 730. In various embodiments, the exemplary system in FIG. 7 can be considered as using high-voltage-discharge plasma unit 701 to replace laser 301 in FIG. 2.

EUV light source material 702 can be, e.g., Xe, Sn, and/or Li. High-voltage-discharge plasma unit 701 can apply high-voltage charging pulses on EUV light source material 702 to produce plasma 703. Plasma 703 can emit EUV light. Collector 704 can at least partially surround EUV light source material 702 and can collect the EUV light.

Cooling assembly 730 can condense droplets 705. The cooling assembly 730 can wrap around to form an exterior wall to cover a predetermined space, in which the EUV light can be guided. In one embodiment, cooling assembly 730 can be used to condense droplets 705 on surface of the cooling assembly to avoid contamination to other optical components. Droplets condensed on surface of the cooling assembly can avoid secondary contaminations.

The cooling assembly can have a cooling material configured therein including, e.g., water coolant, liquid nitrogen, and/or liquid helium. Alternatively, the cooling assembly can be an electro-thermal cooling condenser.

In one embodiment, cooling assembly 730 can be disposed along the guided direction of the EUV light to form a predetermined space such as a cavity (e.g., centered by the guided EUV light). Cooling assembly 730 can wrap around the cavity to form an exterior wall. The EUV light can be guided in the cavity.

In another embodiment, cooling assembly 730 can be configured as a tube containing a cooling material. The tube can wrap around the predetermined space or the cavity of the EUV exposure device to guide the EUV light. The tube can have a cooling material including, e.g., a water coolant, liquid nitrogen, and/or liquid helium, so that the droplets can be condensed on the inner surface of the tube.

Figure 8A:
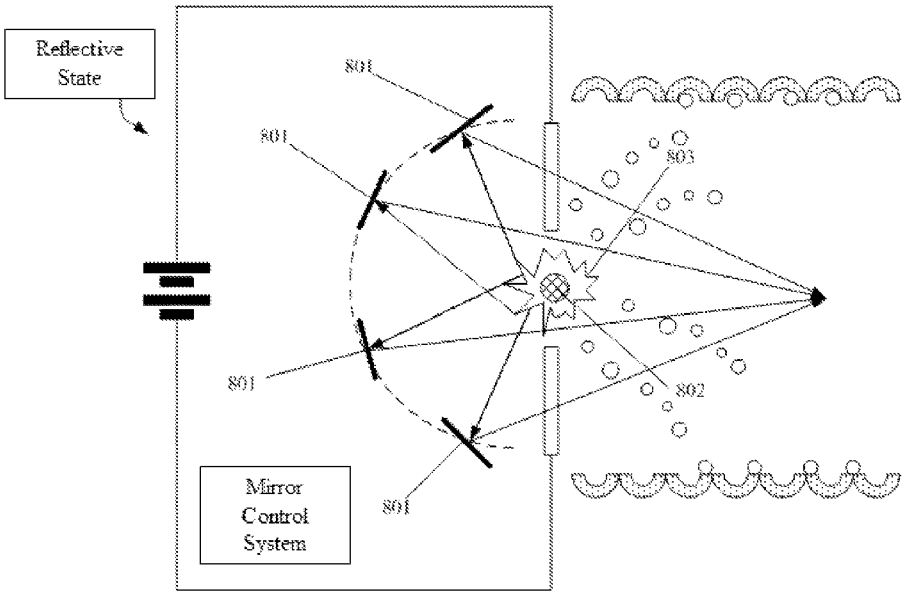
FIG. 8A depicts another exemplary EUVL light source system set in a reflective state in accordance with various disclosed embodiments.
Figure 8B:
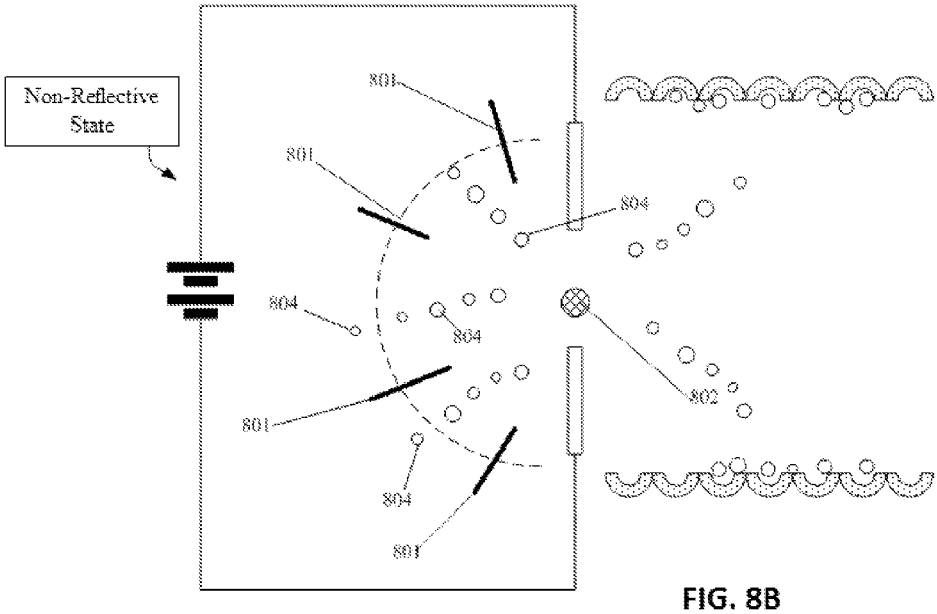
FIG. 8B depicts another exemplary EUVL light source system set in a non-reflective state in accordance with various disclosed embodiments.

FIGS. 8A-8B depict another exemplary EUVL light source system in accordance with various disclosed embodiments. Reflective mirrors in the exemplary system can be in a reflective state as shown in FIG. 8A or in a non-reflective state as shown in FIG. 8B. The collector can be made of multiple reflective mirrors 801, and reflective mirrors 801 can be movable while accommodating the EUV light. In one embodiment, the exemplary EUVL light source systems shown in FIGS. 8A-8B can be considered as using high-voltage-discharge plasma unit to replace laser 420 in FIGS. 3A-3B.

Reflective mirrors 801 can be arranged to guide the EUV light (generated from plasma 803). Any number of reflective mirrors 801 can be included without limitations. In various embodiments, the number of reflective mirrors 801 can be determined according to specific applications and is intended to be encompassed within the scope of the present disclosure.

Reflective mirror 801 can be made of a material including, e.g., molybdenum, molybdenum alloy, silicon, ruthenium and/or ruthenium alloys. Alternatively, reflective mirror 801 can have a silicon substrate, and a surface of the silicon substrate can be coated (or plated) with multilayers of, e.g., silicon molybdenum film, molybdenum alloy, ruthenium, and/or ruthenium alloy film.

Reflective mirrors 801 can be movable and can be set either reflective or non-reflective. The reflective state is suitable for reflecting the EUV light and the non-reflective state is suitable for avoiding contamination of droplets 804 as similarly described above.

For example, the EUV generation device can be a pulsed high-voltage-discharge device as shown in FIGS. 8A-8B (or as shown in FIG. 7) to generate EUV light by exciting EUV light excitation source 802 using high-voltage discharging pulses. That is, the high voltage can be applied in a pulse mode. The EUV generation device can be independent from the EUVL light source system or can be configured within the EUVL light source system. The pulsed high-voltage-discharge device can include a pulsed high voltage generator, or a continuous high voltage generator followed by a pulse modulator.

For illustrative purposes, in this case, the high voltage can have a pulse duration time ranging from about 1 nanosecond to about 1 millisecond. The time of configuring reflective mirrors 801 to be non-reflective can lag behind the pulse duration time of the high-voltage discharge by a delay time T2. That is, a starting time of reflective mirrors 801 being switched to the non-reflective state can lag behind a starting time of the pulse duration time of the high-voltage discharge by a delay time T2.

The delay time T2 is a certain time length that can correspond to the pulse mode of the high voltage, and can be constrained by parameters including, e.g., a pulse duration time of the high voltage, an application time of the high voltage, a speed of the EUV light, designed size of components of the EUV light source system, type of the EUV light source material, and/or size/mas of the droplets.

FIG. 8A depicts reflective mirrors 801 configured to be in a reflective state. For example, EUV light source material 802 can be charged by a pulsed high voltage. When the high voltage is applied to EUV light source material 802, EUV light source material 802 can generate plasma 803 under the high voltage. Plasma 803 can then radiate EUV light, while multiple reflective mirrors 801 can have reflective surfaces at a reflective state facing at the EUV light to guide the EUV light. In one embodiment, reflective mirrors 801 together can form a curved reflective surface.

FIG. 8B depicts reflective mirrors 801 configured to be in a non-reflective state. When the application of the high voltage on EUV light source material 802 stops, reflective mirrors 801 can be configured to be in the non-reflective state. In one embodiment, the reflective surface(s) of reflective mirrors 801 can be rotated relative to (e.g., parallel to) the flying direction(s) of the droplets 504, such that contamination by the droplets 504 at all speeds can be avoided.

In another embodiment, in order to better avoid the contamination by droplets 804, reflective mirrors 801 can be in the reflective state or the non-reflective state corresponding to the pulse mode of the high voltage. When the high voltage is in the pulse mode, a time length of reflective mirrors 801 configured to be in the non-reflective state can lag behind pulse duration time of the high voltage. That is, a starting time of reflective mirrors 801 being in the non-reflective state can lag behind a starting time of the pulse duration time of the high voltage by a delay time T2, in order for the reflective surface of reflective mirrors 801 to avoid facing at the flying direction(s) to receive the droplets 804 at all speeds.

Figure 9:
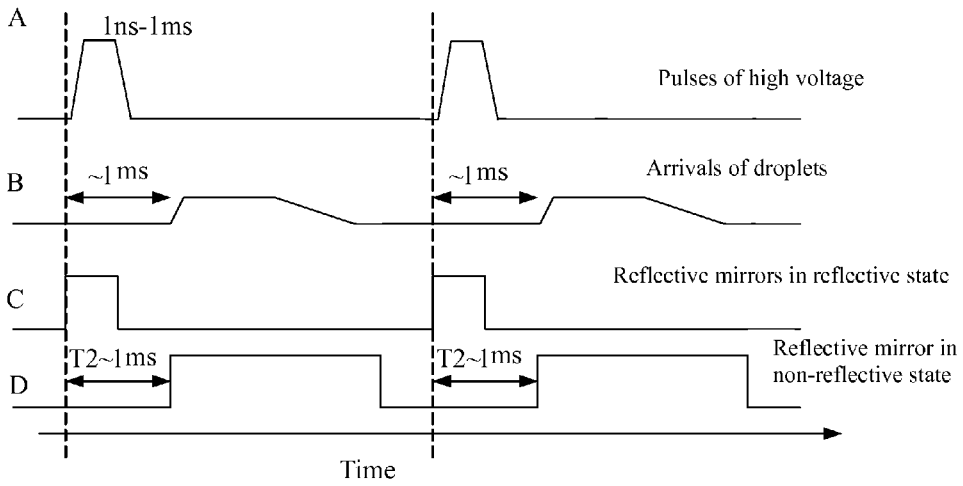
FIG. 9 depicts time sequences of DPP system signals, including pulses of a high voltage discharge, arrivals of droplets, a reflective mirror being in a reflective state, and a reflective mirror being in a non-reflective state, as a function of time in accordance with various disclosed embodiments.

FIG. 9 depicts time sequences of system signals, including pulses of a high voltage, arrivals of droplets, reflective mirror being in a reflective state, and reflective mirror being in a non-reflective state, as a function of time in accordance with various disclosed embodiments.

Waveform A corresponds to pulses of high voltages, waveform B corresponds to arrivals of droplets to the collector, waveform C corresponds to a reflective mirror being in a reflective state, and waveform D corresponds to a reflective mirror being in a non-reflective state. For illustrative purposes, the high voltage can have a pulse duration time from about 1 nanosecond to about 1 millisecond, e.g., less than about 10 microseconds. Fastest droplet(s) 804 can arrive at reflective mirrors 801 from the excitation center for about 1 millisecond.

Waveform A shown in FIG. 9 depicts a pulse frequency of a high voltage. The high voltage can have a pulse duration time less than about 10 milliseconds such as about 1 millisecond. Correspondingly, waveform B shown in FIG. 9 depicts fastest flying time for the fastest droplet(s) 804 to arrive at location of corresponding reflective mirrors 801. For example, the fastest flying time for the fastest droplet(s) 804 can be about 1 millisecond after starting applying the high voltage (i.e., start of the pulse of the high voltage) until droplets 804 arrive at location of corresponding reflective mirrors 801.

Correspondingly, waveform C shown in FIG. 9 depicts reflective mirrors 801 being in the reflective state as a function of time. Because reflective mirrors 801 need to accommodate and guide the EUV light, the time length of reflective mirrors 801 being in the reflective state can be greater than the pulse duration time of the high voltage and less than the fastest flying time of the fastest droplet(s) arriving at location of reflective mirrors 801.

Correspondingly, waveform D shown in FIG. 9 depicts reflective mirrors 801 being in the non-reflective state as a function of time. Reflective mirrors 801 need to be rotated into the non-reflective state before the fastest droplet(s) 804 arrive at location of corresponding reflective mirrors 801. Therefore, the time length of the reflective mirrors 801 being in the non-reflective state can be greater than the time length for droplets 804 at all speeds to pass through location of corresponding reflective mirrors 801. After that, reflective mirrors 801 can enter the reflective state for next pulse of high voltage.

In one embodiment, the high voltage can be in a pulse mode, and can have a pulse duration time ranging from about 1 nanosecond to about 1 millisecond. The starting time of configuring reflective mirrors 801 to be non-reflective can lag behind the pulse duration time of the high voltage (i.e., lag behind starting of the pulse) by a delay time T2 (e.g., about 1 millisecond as depicted by waveform D in FIG. 9).

In various embodiments, reflective mirrors can be moved into the non-reflective state at the delay time T2 after a starting time of each high voltage pulse cycle of the high-voltage discharge. The delay time T2 can be shorter than or substantially equal to the fastest flying time of one or more fastest droplet(s) to fly from the source material (e.g., the excitation center) to reach a location of corresponding reflective mirror (s).

The time length of the reflective mirrors 801 being in the reflective state or the non-reflective state can to be set based on parameters including a pulse duration time of the high voltage, an application time of the high voltage, a speed of the EUV light, designed size of components of the EUV light source system, type of the EUV light source material, and/or size/mass of the droplets. In various embodiments, a mirror control system can be provided to control switching of reflective mirror(s) 801 between the reflective state and the non-reflective state, e.g., via electric control, magnetic control, and/or mechanical control.

Figure 10:
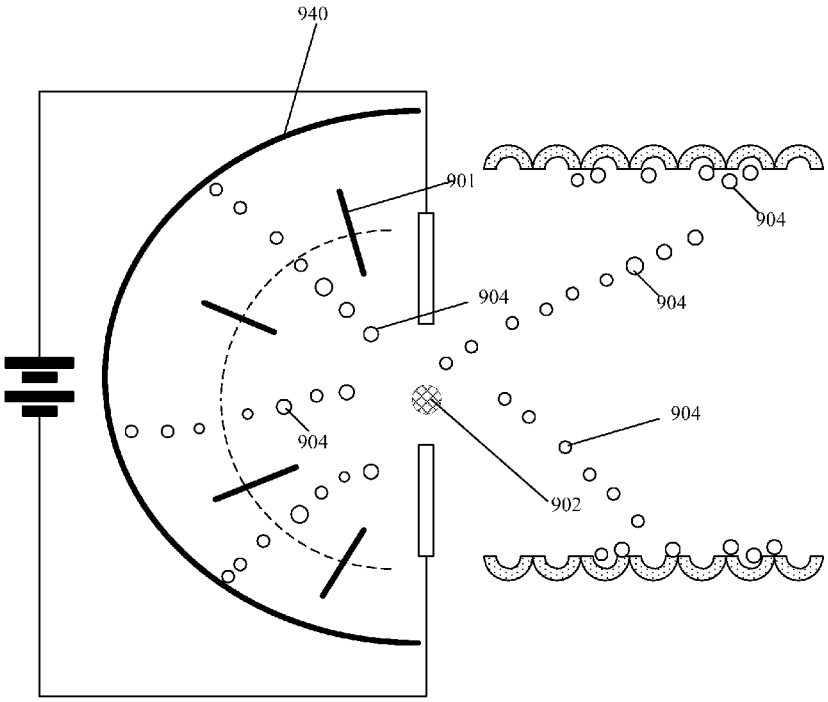
FIG. 10 depicts another exemplary EUVL light source system in accordance with various disclosed embodiments.

FIG. 10 depicts another exemplary EUVL light source system in accordance with various disclosed embodiments. In this exemplary system, outer droplet stopper 940 can be configured on an outer periphery of the collector for the EUV light. Outer droplet stopper 940 can capture droplets 904 flying out of EUV light source material 902 and through collector 901 to avoid contamination of droplets 904 to other possible components of the EUV exposure device.

Outer droplet stopper 940 can include, e.g., a bowl-like structure or a frame-like structure provided outside the collector and surrounding the collector. When the droplet(s) 904 fly out through a gap between adjacent reflective mirrors 901, outer droplet stopper 940 can capture droplets 904, thus preventing droplets 904 from contaminating other components of the EUV exposure device. In various embodiments, outer droplet stopper 940 can be the same as outer droplet stopper 540 in FIG. 5.

According to various embodiments, reflective mirrors can be configured to be movable and rotatable along a predetermined axis, and thus can be configured to be reflective or non-reflective when accommodating EUV light. Thus, reflective mirrors can guide EUV light(s) during the reflective state, the reflective mirrors can avoid from being contaminated by the droplets in the non-reflective state. For example, when the reflective mirrors are configured to be in the non-reflective state, the reflective surface(s) of the reflective mirrors can be rotated to (e.g., parallel to) a flying direction of the droplets, such that contamination of the reflective surfaces of the reflective mirrors by the droplets can be reduced to a minimum. In addition, maintenance cost of the EUV exposure device can be reduced.

Further, the reflective mirrors can be in the reflective state or the non-reflective state corresponding to the pulse mode of the high voltage. The time length of the reflective mirrors being in the reflective state or the non-reflective state can be set based on parameters including a pulse duration time of the high voltage, an application time of the high voltage, a speed of the EUV light, designed size of components of the EUV light source system, type of the EUV light source material, and/or size/mass of the droplets.

In addition, the time length of the reflective mirrors being in the reflective state can be greater than the pulse duration time of the high voltage and less than the fastest flying time of fastest droplets arriving at location of the reflective mirrors. The time length of the reflective mirrors being in the non-reflective state can be greater than the time length for droplets at all speeds to pass through the location of reflective mirrors (or pass through adjacent reflective mirrors), in order to further reduce the contamination by the droplets.

According to various embodiments, there is also provided a method for EUV exposure by: using EUVL light source system to produce EUV light. EUV light source material can also generate droplets to fly out of EUV light source material. A cooling assembly can be used to condense a portion of these droplets. The cooling assembly can wrap around to form an exterior wall, and the exterior wall can cover a predetermined space, in which the EUV light can be guided.

The cooling assembly can be used to condense the droplets, and the droplets can be condensed on the surface of the cooling assembly to avoid contamination of the droplets to other components in the system. In addition, the droplets can be condensed on the surface of the cooling assembly to avoid dripping down and thus secondary contaminations.

The cooling assembly can have a cooling material including, e.g., a water coolant, liquid nitrogen, and/or liquid helium. Or the cooling assembly can be an electro-thermal cooling condenser. In one embodiment, the cooling assembly can wrap around a guided direction of the EUV light to form a predetermined space such as a cavity (e.g., centered by the guided EUV light). The cooling assembly can form an exterior wall around the cavity, in which the EUV light can be guided. The cooling assembly can condense the droplets on the surface of the cooling assembly (i.e., the inner surface of the channel).

In another embodiment, the cooling assembly can be configured as a tube containing a cooling material. The tube can wrap around a predetermined space (or a cavity) of the EUV exposure device where the EUV light can be guided, in a guided direction of the EUV light. The tube can have a cooling material including, e.g., a water coolant, liquid nitrogen, and/or liquid helium, so that the droplets can be condensed on the inner surface of the tube.

In various embodiments, EUVL light source system of FIG. 10 can include the above-described EUVL light source systems. For example, the EUVL light source system can be configured in a reflective state suitable for reflecting EUV light and can be configured in a non-reflective state suitable for avoiding droplet contamination. When the reflective mirrors are set to the non-reflective state, the reflective mirrors can rotate to along the flying direction of the droplets. Specific descriptions can include those described above without limitations.

Note that, in one embodiment, an outer droplet stopper can be setup outside the EUV light collector. The outer droplet stopper can capture droplets flying out of the EUV light source material and though the collector to avoid the droplet contamination of other components of the EUV exposure device.

The outer droplet stopper can be disposed outside the EUV light collector and can have a bowl-like or a frame-like structure surrounding the collector. When the droplets flying out of the gaps between adjacent reflective mirrors (which are set non-reflective), the outer droplet stopper can capture those droplets, thereby avoiding the droplet contamination of other components of the EUV exposure device.

As such, the reflective mirrors can be configured reflective when the EUV light source material produces EUV light; and configured non-reflective after the EUV light has been produced. Thus, reflective surfaces of the reflective mirrors can avoid the droplet contamination to reduce the maintenance cost of the EUV exposure device.

Figure 11:
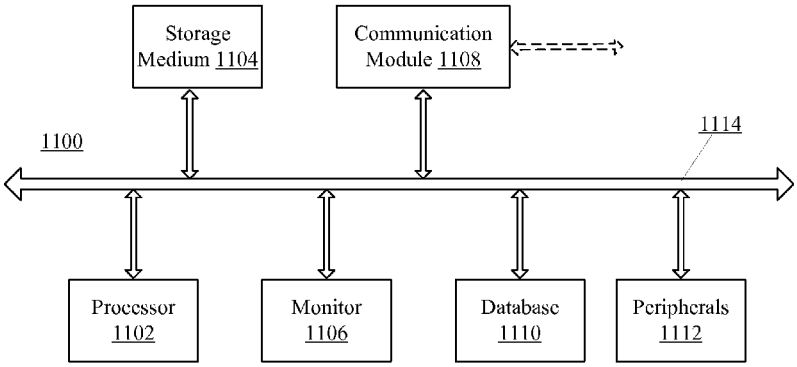
FIG. 11 depicts an exemplary computer-based mirror control system configured in EUVL light source system in accordance with various disclosed embodiments.

The mirror control system can be implemented on any appropriate computer system. For example, FIG. 11 depicts an exemplary computer-based mirror control system consistent with the disclosed embodiments. As shown in FIG. 11, exemplary computer system 1100 may include processor 1102, storage medium 1104, monitor 1106, communication module 1108, database 1110, peripherals 1112, and one or more bus 1114 to couple the devices together. Certain devices may be omitted and other devices may be included.

Processor 1102 can include any appropriate processor(s). Further, processor 1102 can include multiple cores for multi-thread or parallel processing. For example, the processor 1102 can be used to control reflective state and non-reflective state of the reflective mirrors.

Storage medium 1104 may include memory modules, e.g., Read-Only Memory (ROM), Random Access Memory (RAM), and flash memory modules, and mass storages, e.g., CD-ROM, U-disk, removable hard disk, etc. Storage medium 1104 may store computer programs for implementing various processes (e.g., synchronizing moving of reflective mirrors with the laser systems or the pulsed high-voltage discharge system, to properly configure direction of the reflective mirrors), when executed by processor 1102.

Monitor 1106 may include display devices for displaying contents in computing system 1100. Peripherals 1112 may include I/O devices such as keyboard and mouse.

Further, communication module 1108 may include network devices for establishing connections with other computer systems or devices via a communication network. Database 1110 may include one or more databases for storing certain data and for performing certain operations on the stored data, e.g., storing data of pulse generation by laser systems or the pulsed high-voltage discharge system, etc.

The embodiments disclosed herein are exemplary only. Other applications, advantages, alternations, modifications, or equivalents to the disclosed embodiments are obvious to those skilled in the art and are intended to be encompassed within the scope of the present disclosure.

What is claimed is:

1. An EUVL light source system, comprising:

a laser configured to provide laser pulses and to excite an EUV light source material to emit EUV light, wherein a plurality of molten droplets is generated to fly out of the EUV light source material;

a collector comprising a plurality of reflective mirrors each movable, configured to at least partially surround the EUV light source material and positioned to guide the EUV light into a desired direction;

a cooling assembly configured to wrap around the collector along the EUV light in the desired direction, wherein at least a first portion of the plurality of molten droplets reaches and condenses on a surface of the cooling assembly; and a mirror control system synchronized to operate with the laser and configured to control the plurality of reflective mirrors in a reflective state for reflecting the EUV light and in a non-reflective state for allowing at least a second portion of the plurality of molten droplets to pass through adjacent reflective mirrors for preventing contamination from the molten droplets.

2. The system according to claim 1, wherein the cooling assembly comprises an electro-thermal cooling condenser or a cooling material configured therein, the cooling material comprising a water coolant, liquid nitrogen, or liquid helium.

3. The system according to claim 1, wherein the laser provides the laser pulses with a period allowing the second portion of the molten droplets at slower flying speeds than the first portion to pass through adjacent reflective mirrors.

4. The system according to claim 1, wherein:

the plurality of reflective mirrors are controlled to move into the non-reflective state at a delay time T1 after the starting time of each laser pulse; and the delay time T1 is configured to open the reflective mirrors to pass the fastest among the second portion molten droplets.

5. The system according to claim 1, wherein:

a time length for the plurality of reflective mirrors being controlled in the non-reflective state is greater than the time length for all of the second portion of the molten droplets at various speeds to pass through adjacent reflective mirrors.

6. The system according to claim 1, wherein each of the plurality of reflective mirrors comprises a reflective surface comprising:

a material comprising molybdenum, molybdenum alloy, silicon, ruthenium, a ruthenium alloy, or a combination thereof; or a multi-layer structure comprising one or more of a silicon molybdenum film, a molybdenum alloy, ruthenium, and a ruthenium alloy film, formed on a substrate.

7. The system according to claim 1, further comprising:

an outer droplet stopper provided on an outer periphery of the collector to receive molten droplets passing through the collector.

8. An EUVL light source system, comprising:

a high-voltage-discharge device configured to provide a high-voltage discharge pulse to excite an EUV light source material to emit EUV light, wherein a plurality of molten droplets is generated to fly out of the EUV light source material;

a collector comprising a plurality of reflective mirrors each movable, configured to at least partially surround the EUV light source material and positioned to guide the EUV light into a desired direction;

a cooling assembly configured to wrap around the collector along the EUV light in the desired direction, wherein at least a first portion of the plurality of molten droplets reaches and condenses on a surface of the cooling assembly; and a mirror control system synchronized to operate with the high-voltage-discharge device and configured to control the plurality of reflective mirrors in a reflective state for reflecting the EUV light and in a non-reflective state for allowing at least a second portion of the plurality of molten droplets to pass through adjacent reflective mirrors for preventing contamination from the molten droplets, wherein the plurality of reflective mirrors in the non-reflective state is configured substantially parallel to a flying direction of the second portion of the molten droplets.

9. The system according to claim 8, wherein the cooling assembly comprises an electro-thermal cooling condenser or a cooling material configured therein, the cooling material comprising a water coolant, liquid nitrogen, or liquid helium.

10. The system according to claim 8, wherein the high-voltage-discharge device provides the high-voltage discharge pulse with a period allowing the second portion of the molten droplets at slower flying speeds than the first portion to pass through adjacent reflective mirrors.

11. The system according to claim 8, wherein:

the plurality of reflective mirrors are controlled to move into the non-reflective state at a delay time T1 after the starting time of each laser pulse; and the delay time T1 is configured to open the reflective mirrors to pass the fastest among the second portion molten droplets.

12. The system according to claim 8, wherein:

a time length for the plurality of reflective mirrors being controlled in the non-reflective state is greater than the time length for all of the second portion of the molten droplets at various speeds to pass through adjacent reflective mirrors.

13. The system according to claim 8, further comprising:

an outer droplet stopper provided on an outer periphery of the collector to receive molten droplets passing through the collector.

14. A method for configuring an EUVL light source system, comprising:

providing a laser or a high-voltage-discharge device to excite an EUV light source material to emit EUV light, wherein a plurality of molten droplets is also generated to fly out of the EUV light source material;

positioning a collector to guide the EUV light generated from the EUV light source material into a desired direction, the collector comprising a plurality of reflective mirrors each movable, configured to at least partially surround the EUV light source material;

configuring a cooling assembly to wrap around the collector along the EUV light in the desired direction, wherein at least a first portion of the plurality of molten droplets reaches and condenses on a surface of the cooling assembly; and configuring a mirror control system synchronized to operate with the laser or the high-voltage-discharge device to control the plurality of reflective mirrors in a reflective state for reflecting the EUV light and in a non-reflective state for allowing at least a second portion of the plurality of molten droplets to pass through adjacent reflective mirrors for preventing contamination from the molten droplets, wherein the plurality of reflective mirrors in the non-reflective state is controlled substantially parallel to a flying direction of the second portion of the molten droplets.

15. The method according to claim 14, further comprising:

configuring the plurality of reflective mirrors to move into the non-reflective state at a delay time T1 after the starting time of each laser pulse, wherein the delay time T1 is configured to open the reflective mirrors to pass the fastest among the second portion molten droplets.

16. The method according to claim 14, further comprising:

configuring the plurality of reflective mirrors being in the non-reflective state for a time length greater than a time length for all of the second portion of the molten droplets at different flying speeds to pass through adjacent reflective mirrors.

17. The method according to claim 15, further comprising:

providing the laser or the high-voltage-discharge device capable of providing laser pulses or high-voltage-discharge pulses with a period allowing the second portion of the molten droplets at slower flying speeds than the first portion to pass through adjacent reflective mirrors.

* * * * *